United States Patent [19]

MacCready

[11] Patent Number: 4,561,695

[45] Date of Patent: Dec. 31, 1985

[54] SEAT WITH FOAM SNAP-ON COVER

[75] Inventor: Willis MacCready, Jackson, Mich.

[73] Assignee: Michigan Seat Company, Jackson, Mich.

[21] Appl. No.: 582,849

[22] Filed: Feb. 23, 1984

[51] Int. Cl.[4] ..... A47C 7/02

[52] U.S. Cl. ..... 297/452; 297/458; 297/DIG. 1

[58] Field of Search ..... 297/452, 195, DIG. 1, 297/DIG. 2, 458, 459, 460

[56] References Cited

U.S. PATENT DOCUMENTS

| | | | |
|---|---|---|---|
| 2,893,476 | 7/1959 | Liljengren | 297/306 |
| 3,669,498 | 6/1972 | Meyers et al. | 297/452 |
| 3,833,260 | 9/1974 | Harder, Jr. | 297/452 |
| 4,103,966 | 8/1978 | Allen | 297/195 |
| 4,451,083 | 5/1984 | Marchello | 297/195 |

FOREIGN PATENT DOCUMENTS

| | | | |
|---|---|---|---|
| 2717268 | 10/1978 | Fed. Rep. of Germany | 297/DIG. 1 |
| 678905 | 12/1964 | Italy | 297/DIG. 1 |
| 1440532 | 6/1976 | United Kingdom | 297/DIG. 1 |

*Primary Examiner*—James T. McCall

*Attorney, Agent, or Firm*—Beaman & Beaman

[57] ABSTRACT

The invention pertains to a seat utilizing a resilient synthetic foam cushion wherein the peripheral region of the cushion includes a hook and lip configuration snapping over the seat pan peripheral edge to permit self-assembly of the cushion to the seat pan without requiring additional assembly components.

1 Claim, 3 Drawing Figures

SEAT WITH FOAM SNAP-ON COVER

BACKGROUND OF THE INVENTION

The invention pertains to seats, and particularly relates to seats of the type employing a sheet metal contoured pan upon which a resilient foam cushion is assembled. Such seats are commonly employed on industrial equipment, tractors, riding lawnmowers and the like.

In the past, seats of the above type are fabricated by supporting a foam cushion upon a sheet metal seat pan wherein the cushion lower surface closely conforms to the pan, and a retainer is utilized at the pan and cushion peripheries to mechanically assemble the cushion to the pan. The retainer is usually in the form of a pinch rim or bead of a U cross sectional configuration which receives the cushion cover and pan and mechanically holds these components in contiguous relationship. This mode of assembly is troublesome and expensive, and during use the retainer may work loose of the pan causing disassembly of the seat components.

It is known to mold resilient cushions to a seat pan or support, and it is also known to extend the foam about the edge of the pan. For instance, U.S. Pat. Nos. 2,893,476; 3,669,498; 3,833,260 and 4,103,966 disclose seat constructions wherein the cushion extends adjacent, and partially about, the pan periphery, but these seat constructions are of a molded type, and the cushion is not separately assembled to the pan.

It is an object of the invention to provide a seat assembly utilizing a metal pan and a resilient foam cushion wherein the cushion is mechanically connected to the pan without requiring separate retainer or assembly structure.

Yet another object of the invention is to provide a seat assembly utilizing a pan and a foam cushion wherein the cushion is self-connecting to the pan, and the seat assembly basically consists of only the pan and cushion, eliminating additional retainer assembly components.

Another object of the invention is to provide a seat assembly employing a pan and flexible foam cushion wherein the cushion is of such configuration adjacent its periphery that the cushion "snaps on" the pan, and the cushion configuration includes a hook and lip configuration to produce the desired self-attachment function.

Another object of the invention is to provide a resilient synthetic foam cushion of such configuration that the cushion is self-attachable to a seat pan by a "snap-on" connection.

In the practice of the invention a contoured sheet metal pan includes a peripheral edge, and a synthetic foam cushion rests upon the upper surface of the pan to provide the seating surface. The cushion usually includes a cover, such as of vinyl.

The cushion is provided with a peripheral region of foam which is shaped to extend about the pan periphery, and this cushion peripheral region is formed with a hook and lip configuration wherein the lip extends "inwardly" toward the pan and is so shaped as to closely embrace the pan peripheral edge. In this manner the cushion is "snapped on" the pan, and the cushion is maintained in its assembled relationship to the pan solely by the hook and lip shape of the cushion periphery itself.

The peripheral region of the cushion is such that sufficient foam material exists at the hook and lip region to impart to the cushion peripheral region the necessary strength and resistance to deformation to permit the cushion to achieve a firm mechanical relationship to the pan. During assembly the cushion is stretched to distribute the cushion over the pan and permit the lip to be pushed over the pan edge, and the natural resiliency of the cushion material causes the cushion to closely conform to the upper surface and periphery of the pan.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 2:
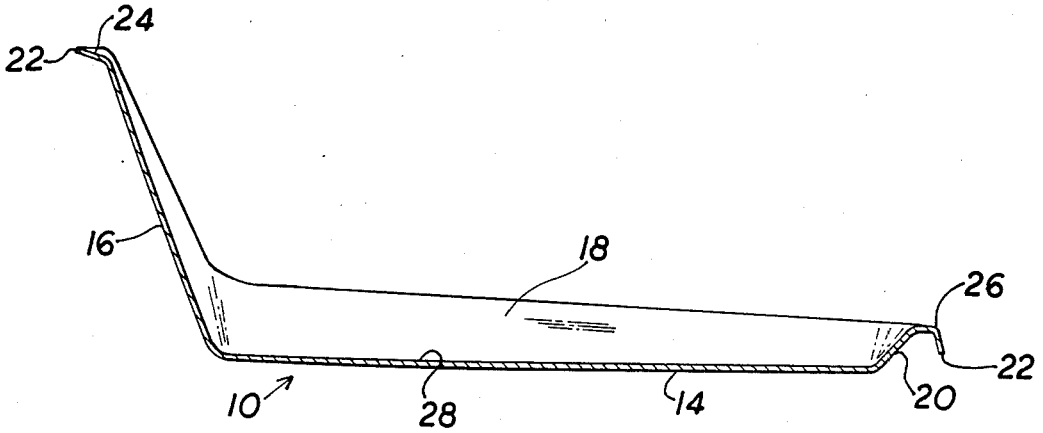
FIG. 2 is an elevational, sectional view of a seat pan, per se, and FIG. 3 a perspective view of the underside of a seat assembly in accord with the invention.
Figure 3:
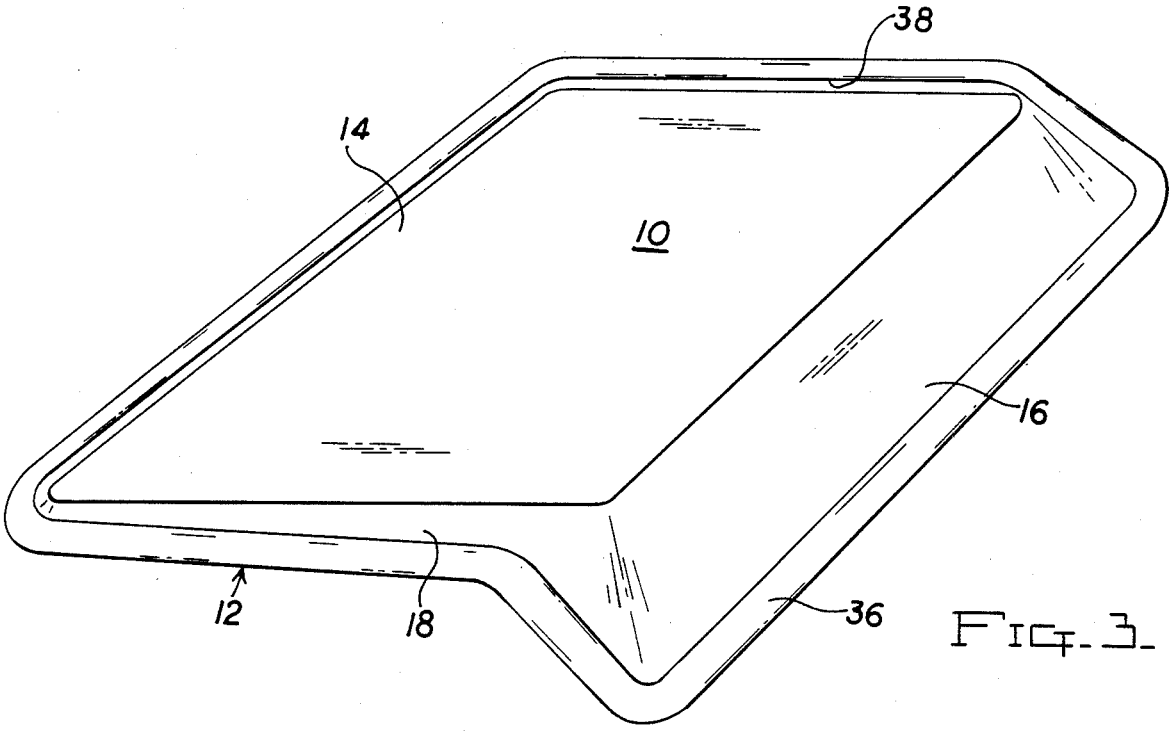

A seat assembly in accord with the concepts of the invention consists of two components, a sheet metal pan 10, and a resilient foam cushion 12. The pan 10 is formed in the desired configuration and will usually includes a bottom portion 14, a back portion 16, which often extends, at least partially, along the sides of the seat as at 18, and a front portion 20. The pan is provided with a peripheral edge 22, and as will be appreciated from FIG. 2, the configuration of the pan adjacent the edge will vary in accord with the portion of the pan to which the periphery is associated. For instance, the peripheral region 24 adjacent the back 16 is relatively planar, while the peripheral portion 24 at the pan front edge 26 is of a generally inverted U cross-sectional configuration. The pan upper surface 28 will directly engage the cushion, while the pan bottom surface often has brackets or weldments attached thereto, not shown, for affixing the pan to vehicle support structure. The pan is normally formed of sheet metal by a stamping and drawing process, but the pan could be formed of other materials, including rigid synthetic material compositions.

The cushion 12 is basically formed of a synthetic foam, such as blown urethane, as is commonly employed in the vehicle seat art. Basically, the cushion is of a general configuration corresponding to the pan with which it will be used, and the cushion includes a lower surface 30 of a configuration complementary to the pan upper surface 28. The thickness of the cushion may vary throughout its form, ribs are often defined in the foam upper surface, and a vinyl cover 32 is bonded to the cushion upper surface, and for the purpose of this invention, the vinyl cover is considered as being integral with the cushion material and extends over the foam surface and peripheral region thereof.

Figure 1:
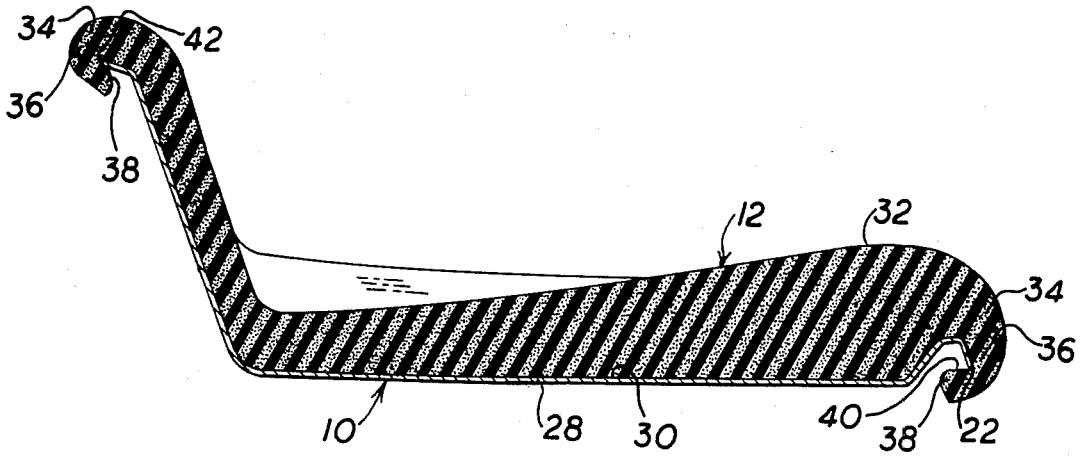
FIG. 1 is an elevational, sectional view of a seat assembly in accord with the invention.

The cushion peripheral region 34 is formed with a hook portion 36 terminating in a lip 38. As will be appreciated from FIG. 1, the hook portion 36 extends over the peripheral regions of the pan 10, and accordingly, is of a configuration complementary to the pan peripheral configuration. The inner surface 40 of the hook portion is shaped to closely engage the pan peripheral portion, and accordingly, the cushion inner surface 30 will vary to conform to the variable shape of the pan peripheral region. The lip 38 extends "inwardly" from its associated hook portion 36 a sufficient distance to provide a groove 42 into which the pan peripheral edge 22 is received. The inward extension of the lip 38 is sufficient to prevent inadvertent release of the cover from the pan, and as will be appreciated from FIG. 2, the "thickness" dimension through the hook portion 36 between the groove 42 and the cushion cover is sufficient to fully pad the pan edge 22 and impart to the hook portion sufficient mechanical strength to permit the hook to maintain its shape even though the cushion may be under slight tension due to its being stretched and assembled to the pan.

To assemble the cushion 12 to its pan the hook portion 36 is deformed slightly to "open" the groove 42, and the cushion is slipped over the pan periphery to receive the pan edge 22 into the cushion groove 42. Due to the complementary configuration between the pan and cushion peripheral regions, the cushion, once it has been "snapped on" the pan, there may be a slight tension in the cushion, but the same is not necessary to maintain proper assembly. Of course, due to the resilient nature of the foam forming the hook and lip configuration of the peripheral portion 34, the cushion will intimately "grip" the edge of the pan and a firm mechanical interconnection between the cushion and pan is achieved.

If the cushion, or its cover, is damaged, and the cushion is to be replaced, the cushion lip 38 may be "pulled back" away from the pan periphery releasing the cushion from the pan, and a new cushion very quickly assembled to the pan.

The invention permits assembly of the aforedescribed type of seat to be very readily accomplished with a minimum of components, and replacement of the cushion can be achieved by the vehicle owner without special skills. Of course, the density, strength and resiliency of the cushion material must be sufficient to produce the desired mechanical relationship between the cushion peripheral region and the pan periphery, and the fact that the peripheral region of the cushion extends over the pan throughout its form produces a very attractive seat.

In its preferred form, the hook portion 36 and lip 38 extend continuously about the periphery of the cushion, and is associated continuously with the periphery of the pan. However, it is within the scope of the invention to include the formation of hook and lip portions at spaced locations about the cushion periphery to achieve the desired seat assembly.

It is appreciated that various modifications to the inventive concepts may be apparent to those skilled in the art without departing from the spirit and scope of the invention.

I claim:

1. A flexible resilient synthetic foam seat comprising, in combination, a sheet metal contoured pan having an upper surface and having a bottom portion having a front, back and sides, a front portion extending upwardly from said bottom portion front having an inverted U-shaped configuration including a downwardly extending peripheral portion, back and side portions extending upwardly from said bottom portion back and sides each having a peripheral portion angularly related to the associated back and side portion and extending away from a vertical projection of said bottom portion, a peripheral edge defined upon said peripheral portions of said front, back and side portions, a synthetic foam cushion having a contoured lower surface complementary to said pan configuration and engaging said pan upper surface, said cushion having a cushion dimension thickness overlying said pan upper surface including said front, back and side peripheral portions, a homogeneous peripheral foam portion defined upon said cushion extending beyond said peripheral portion of said front, back and sides, a homogeneous deformable foam hook and lip defined continuously about said cushion peripheral portion extending about and around said peripheral portion's peripheral edge to mechanically connect said cushion to said peripheral edges with a snap-on action, said foam cushion including an upper surface, and a flexible cover affixed to said cushion upper surface extending thereover and about said hook and lip.

* * * * *